United States Patent [19]

Snider

[11] Patent Number: 4,708,308

[45] Date of Patent: Nov. 24, 1987

[54] PORTABLE STOOL

[76] Inventor: Robert C. Snider, 5485 Spencer Hale Rd., Morristown, Tenn. 37814

[21] Appl. No.: 818,861

[22] Filed: Jan. 14, 1986

[51] Int. Cl.[4] ..... F16M 11/32

[52] U.S. Cl. ..... 248/165; 248/164; 248/432; 297/440; 297/441

[58] Field of Search ..... 248/165, 164, 431, 432; 297/440, 441

[56] References Cited

U.S. PATENT DOCUMENTS

| | | | |
|---|---|---|---|
| 335,823 | 2/1886 | von der Linden | 248/165 |
| 646,661 | 4/1900 | Hanstein . | |
| 661,036 | 11/1900 | Clark | 248/165 |
| 1,355,944 | 10/1920 | Dale | 248/164 X |
| 1,477,233 | 12/1923 | Alexander | 248/165 X |
| 2,115,258 | 4/1938 | Ferreira et al. . | |
| 2,209,145 | 7/1940 | Weber . | |
| 2,473,090 | 6/1949 | Becker | 297/441 X |
| 2,509,451 | 5/1950 | Reinholz . | |
| 2,564,915 | 8/1951 | Nelson . | |
| 2,712,348 | 7/1955 | Le Voir . | |

FOREIGN PATENT DOCUMENTS

| | | | |
|---|---|---|---|
| 443044 | 2/1936 | United Kingdom | 248/164 |

*Primary Examiner*—Richard J. Scanlan, Jr.
*Attorney, Agent, or Firm*—Luedeka & Neely

[57] ABSTRACT

A stool comprising hub means, seat leg members attached to the hub means and support leg members attached to the hub means. Seat means interconnect the seat leg members.

6 Claims, 5 Drawing Figures

PORTABLE STOOL

The present invention relates generally to furniture and more particularly to a collapsible stool.

There are many indoor and outdoor activities, such as picnics, parades and sporting events, for example, at which adequate seating facilities are not supplied. As a result of the inadequate supply, many people are required to either stand or sit on the ground for extended periods of time. Obviously, such a situation is unsatisfactory to many people as shown by the fact that they often carry along some type of seat, such as a folding lounge chair. While such chairs may provide a comfortable seat during the activity they are extremely cumbersome to carry to and from the event. They are also too bulky for convenient storage between uses.

While efforts have been made to develop a collapsible seat which is compact for storage and transportation, the results have not been completely satisfying. Prior seats have usually been too long to carry in a purse, hang from a belt, or even store in a drawer, for example. Primarily, it is the length of the legs which provides the greatest difficulty. Some of the prior collapsible seats have included segmented legs which required substantial "on-site construction" or, as an alternative, included telescoping legs. However, such stools have been known to provide certain embarrassing moments for users when the legs have collapsed unexpectedly because of improper construction or insufficient tightening of joints.

Generally, a stool in accordance with the present invention includes central hub means and a plurality of elongated leg members pivotally attached to the hub means. The plurality of leg members includes at least three support leg members for engagement with the ground or floor and at least three seat leg members. The seat leg members are interconnected by seat means adapted to carry a person.

It is therefore an object of the present invention to provide a simple, collapsible seat. It is also an object to provide a seat which is stable, even on irregular terrain. It is a further object to provide a seat which is collapsible to a size adapted to be carried unobtrusively and stored conveniently. It is a still further object to provide a seat which is easily constructed and collapsed by the user. Further objects and advantages will be apparent when the following description is considered in connection with the accompanying drawings, in which.

Figure 1:
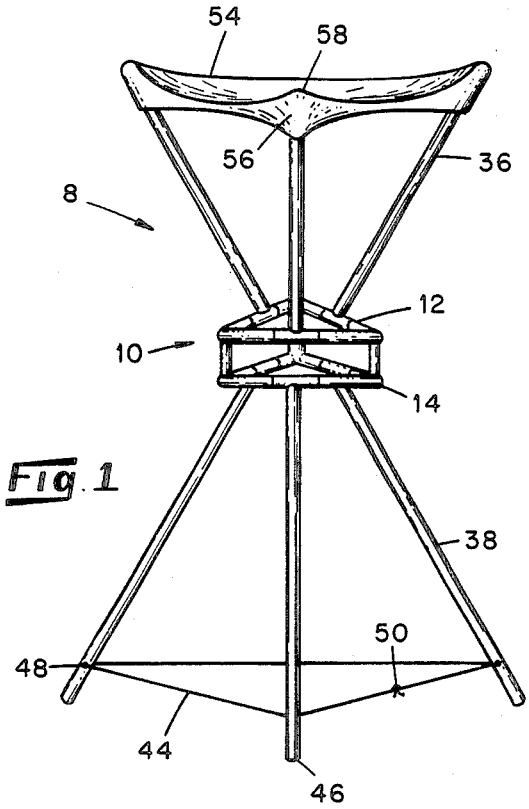
FIG. 1 is a perspective view of a stool embodying various features of the present invention.
Figure 2:
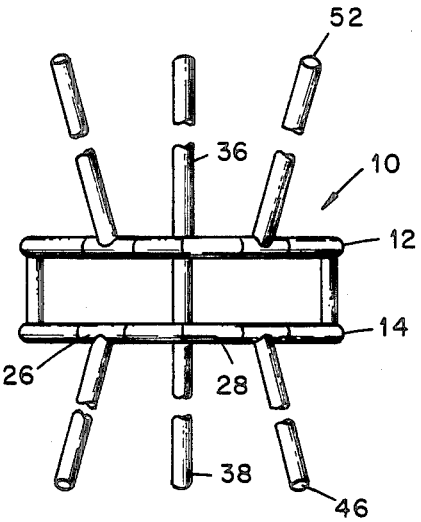
FIG. 2 is an elevational view of the framework of the stool of FIG. 1.
Figure 3:
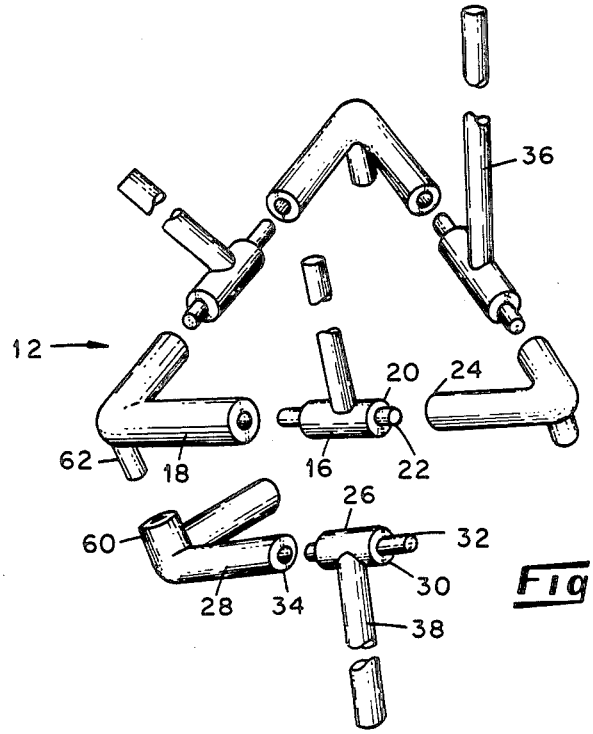
FIG. 3 is an exploded view of a portion of the framework of FIG. 2.

Referring to the drawings, in the depicted embodiment of a stool 8, the hub means 10 comprises a seat hub 12 and a support hub 14. The seat hub 12 is planar and triangular in shape. The hub 12 is constructed from three identical tubular side sections 16 and three identical tubular corner sections 18. Each end 20 of each of the side sections 16 includes a longitudinally extending inner sleeve 22 which is adapted for frictional mating engagement with a tubular end 24 of one of the corner sections 18. The hub 12 is about three inches in length from corner to corner and the tubular sections 16 and 18 are about one-half inch in diameter.

The support hub 14 is also planar and triangular in shape. The hub 14 is constructed from three identical tubular side sections 26 and three identical tubular corner sections 28. Like the ends 20 of the side sections 16, each end 30 of each of the side sections 26 includes a longitudinally extending inner sleeve 32 which is adapted for frictional mating engagement with the tubular end 34 of one of the corner sections 28. The hub 14 is about three inches in length from corner to corner and the tubular sections 26 and 28 are about one-half inch in diameter.

An elongated seat leg member 36, about ten inches in length, is attached to each of the three side sections 16 of the seat hub 12 and an elongated support leg member 38, about ten inches in length, is attached to each of the three side sections 26 of the support hub 14. The leg members 36 and 38 are preferably pivotally mounted relative to the axis of the respective side section 16 or 26 to which it is attached. In the depicted embodiment, the leg members 36 and 38 are fixedly attached to the side sections 16 and 26, respectively. The mating sleeve-type connection between the side sections 16 and 26 and the respective corner sections 18 and 28 permits the sections 16 and 26 and the respective attached leg members 36 and 38 to pivot about the longitudinal axes of the side sections 16 and 26.

Figure 5:
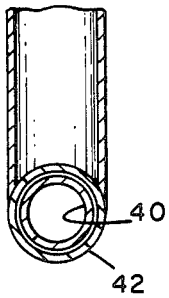
FIG. 5 is a cross-sectional view of an alternative embodiment of a side section.

Alternatively, as shown in FIG. 5, the side sections 16 and 26 may comprise a pair of coaxial tubes 40 and 42 which are rotatable relative to one another. That is, the longitudinally extending sleeves 22 and 32 may comprise a tube 40 which extends entirely through the tubular side member 42 for fixed mating engagement with the corner sections 18 and 28, respectively. In this embodiment, the side member 42 is adapted to rotate relative to the inner tube 40, providing the leg member 36 or 38 with pivotal motion relative to the axis of the tube 40 or 42, respectively.

When the stool 8 is in an expanded position adapted for sitting, the support hub 14 is located in a horizontal position, below and parallel to the seat hub 12. The support leg members 38 extend outwardly and downwardly form the hub 14 to define a tripod, a configuration well-known as being exceedingly stable, even on irregular terrain. A flexible elongated member 44, comprising a nylon rope, for example, interconnects the leg members 38 at locations adjacent to the outboard ends 46. The member 44 prevents the leg members 38 from pivoting outwardly past a position predetermined by the length of the member 44. The flexible member 44 is connected to each of the leg members 38 by passing through a pair of opposed apertures 48 defined in each of the leg members 38. Adjustment of the length of the flexible member 44 by selective location of the knot 50 permits adjustment of the overall height of the stool 8 by controlling the degree of pivot of the leg members 38. In the depicted embodiment, the overall height of the stool 8 is about eighteen inches.

When the stool 8 is in an expanded position for sitting, the seat hub 12 is horizontal and the seat leg members 36 extend outwardly and upwardly from the hub 12 to define an inverted, truncated, triangular pyramid. The leg members 36 are interconnected at their outboard ends 52 by a seat member 54, which preferably comprises a flexible fabric such as nylon net or canvas. The seat member 54 is in the shape of an equilateral triangle, about 12 inches on a side. Three elongated pockets 56 are sewn onto the member 54, one pocket 56 being located at each corner 58 of the triangle. Each of the pockets 56 is about two inches long, and bisects the angle of a corner 58. The pockets 56 are adapted to receive the outboard ends 52 of the seat leg members 36. When the three ends 52 are fully inserted into the pockets 56 and the seat member 54 is stretched taut for sitting, the seat member 54 restrains the leg members 36 from pivoting downwardly away from each other. The seat is comfortable to the user because its flexible nature permits it to mold to the particular shape of the user.

Means are provided for separably attaching the hubs 12 and 14 together in a parallel relationship. Each of the corner sections 28 of the support hub 14 includes an integral outer attaching member 60 which extends perpendicularly from the plane defined by the support hub 14. The attaching members 60 are tubular, having a diameter of about one-half inch and a length of about one inch.

Each of the corner sections 18 of the seat hub 12 includes an integral, inner attaching member 62 which extends perpendicularly from the plane defined by the seat hub 12. Each of the attaching members 62 is adapted to matingly engage one of the attaching members 60 of the support hub 14 by having an outer diameter which is less than the interior diameter of the tubular attaching member 60.

The attaching members 60 and 62 are arranged on the respective hubs 12 and 14 such that the three mating pairs of members 60 and 62 simultaneously engage to form a composite hub when the stool 8 is in an expanded position for sitting. Thus, when the depicted stool is in use, the seat hub 12 and support hub 14 are securely connected in horizontal, parallel relation by mating engagement of the three pairs of attaching members 60 and 62. The support leg members 38 are pivoted outwardly from the support hub 14 to a tripod position and maintained in this position by the flexible member 44. The member 44 interconnects the leg members 38 by being threaded through the apertures 48 in the leg members 38 and tied at the knot 50. The seat leg members 36 are also pivoted outwardly from the seat hub 12. The outboard ends 52 of the seat leg members 36 are fully inserted in the pockets 56 of the seat member 54 and thus prevented from further pivotal motion. Nevertheless the seat member 54 is flexible and molds itself to the shape of the user.

Figure 4:
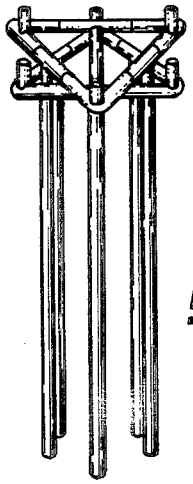
FIG. 4 is a perspective view of the framework of FIG. 1 in a collapsed condition.

After use, the stool 8 is collapsed for transportation and storage by removing the seat member 54 from the leg members 36. The flexible nature of the seat member 54 and the pivotal movement of the seat leg members 36 permit easy removal of the seat member 54. The seat hub 12 is disengaged from the support hub 14 and the seat leg members 36 are then pivoted to positions parallel to one another and perpendicular to the plane defined by the seat hub 12. Similarly, the flexible member 44 is untied and withdrawn from the leg members 38, and the leg members are pivoted to positions parallel to one another and perpendicular to the plane defined by the support hub 14. In order to further compact the disassembled stool 8, the seat leg members 36 are then inserted through the support hub 14, in an orientation in which each seat leg member 36 is located adjacent to a corner section 28 of the support hub 14, until the seat hub 12 engages the support hub 14, as shown in FIG. 4. The seat member 54 is then wrapped around the leg members 36 and 38 and the flexible member 44 is used to tie the entire collapsed stool together in a package which is about ten inches long and three inches in diameter.

A stool in accordance with the present invention is thus conveniently collapsed for storage, even in a purse or hung from a belt. The stool is also easily stored in a drawer, for example. Yet the stool is simply reassembled to a stable configuration and convenient height at the desired location.

While a preferred embodiment has been shown and described herein, it will be understood that there is no intent to limit the invention by such disclosure, but rather, it is intended to cover all modifications and alternate constructions falling within the spirit and scope of the invention as defined in the appended claims.

What is claimed is:

1. A stool comprising:

hub means;

a plurality of elongate seat leg members pivotally connected at one of their ends to said hub means;

a plurality of elongate support leg members pivotally connected at one of their ends to said hub means separately of said seat leg members for pivotal movement independently of said seat leg members;

seat means interconnecting said seat leg members at their ends opposite the ends connected to said hub means and configured to provide a seating surface extending between said ends interconnected by said seat means;

means for restricting said support leg members from pivoting on said hub means beyond a predetermined degree of separation in relation to adjacent support leg members; and said hub means comprising a seat hub to which said seat leg members are pivotally connected, a support hub to which said support leg members are pivotally connected, means for detachably attaching said seat hub to said support hub and configured to maintain said seat hub in a fixed, spaced-apart relation to said support hub, and said support and seat leg members being pivotally movable on said support hub and seat hub, respectively, when said seat hub and support hub are maintained in said fixed, spaced-apart relation.

2. The stool of claim 1, wherein said seat hub comprises a plurality of horizontally disposed side members, each of which has a longitudinal axis, means for rigidly interconnecting said side members, and said seat leg members are pivotally connected to said side members for pivotal movement about the longitudinal axes of said side members.

3. The stool of claim 2, wherein said support hub comprises a plurality of horizontally disposed side members, each of which has a longitudinal axis, and means for rigidly interconnecting said side members of said support hub together, and said support leg members are pivotally connected to said side members of said support hub for pivotal movement about the longitudinal axes of said side members.

4. The stool of claim 1, wherein said seat and support hubs have a substantially planar configuration and said means for detachably attaching is configured so that the plane of said seat hub is substantially parallel to the plane of said support hub.

5. The stool of claim 1, wherein said seat and support hubs are triangular in configuration, three of said seat leg members are provided and each is pivotally connected to a side of said triangular seat hub and spaced about 120° from adjacent seat leg members, three of said support leg members are provided and each is pivotally connected to a side of said triangular support hub and spaced about 120° from adjacent support leg members, and said means for detachably attaching is configured to dispose said triangular seat and support hubs in generally parallel planes.

6. The stool of claim 1, wherein said seat means is configured to limit diverging pivotal movement of said seat leg members and is the sole means by which said diverging pivotal movement of said seat leg members is prevented.

* * * * *